US012269999B2

(12) United States Patent
Ferreira

(10) Patent No.: US 12,269,999 B2
(45) Date of Patent: Apr. 8, 2025

(54) PROCESS FOR THE PRODUCTION OF WHITE OILS

(71) Applicant: TOTALENERGIES ONETECH, Courbevoie (FR)

(72) Inventor: Cristina Ferreira, Paris (FR)

(73) Assignee: TOTALENERGIES ONETECH, Courbevoie (FR)

( * ) Notice: Subject to any disclaimer, the term of this patent is extended or adjusted under 35 U.S.C. 154(b) by 0 days.

(21) Appl. No.: 18/018,650

(22) PCT Filed: Aug. 5, 2021

(86) PCT No.: PCT/EP2021/071880

§ 371 (c)(1),
(2) Date: Jan. 30, 2023

(87) PCT Pub. No.: WO2022/029233

PCT Pub. Date: Feb. 10, 2022

(65) Prior Publication Data

US 2023/0303936 A1 Sep. 28, 2023

(30) Foreign Application Priority Data

Aug. 7, 2020 (EP) ..... 20305911

(51) Int. Cl.
*C10G 65/08* (2006.01)

(52) U.S. Cl.
CPC ..... *C10G 65/08* (2013.01); *C10G 2300/202* (2013.01); *C10G 2300/70* (2013.01); *C10G 2400/14* (2013.01)

(58) Field of Classification Search
CPC ..... C10G 45/46; C10G 67/02; C10G 2300/1044; C10G 2300/1059;
(Continued)

(56) References Cited

U.S. PATENT DOCUMENTS

2009/0166251 A1* 7/2009 Hantzer ..... C10G 45/04 208/58
2010/0279849 A1* 11/2010 Kuperman ..... C10G 45/04 502/154

(Continued)

FOREIGN PATENT DOCUMENTS

CN 101343558 A 1/2009
CN 107629817 A 1/2018

(Continued)

OTHER PUBLICATIONS

ISR-WO dated Oct. 28, 2021 for parent application PCT/EP2021/071880.

*Primary Examiner* — Randy Boyer
*Assistant Examiner* — Juan C Valencia
(74) *Attorney, Agent, or Firm* — Vorys, Sater, Seymour and Pease, LLP

(57) ABSTRACT

The invention is a process for producing a white oil having an initial boiling point of at least 250° C., the process comprising a step of catalytically hydrogenating a base oil feedstock at a temperature of from 120 to 210° C., at a pressure of from 30 to 160 bars and a liquid hourly space velocity of 0.2 to 5 $hr^{-1}$, the base oil feedstock comprising less than 5 ppm by weight of sulphur.

18 Claims, 2 Drawing Sheets

(58) Field of Classification Search
CPC ..... C10G 2300/202; C10G 2300/301; C10G 2300/302; C10G 2300/304; C10G 2300/4006; C10G 2300/4018; C10G 2400/14; C10G 2300/1055
See application file for complete search history.

(56) References Cited

U.S. PATENT DOCUMENTS

| | | | | |
|---|---|---|---|---|
| 2012/0000818 | A1* | 1/2012 | Dougherty | C10G 45/58 208/97 |
| 2014/0291201 | A1* | 10/2014 | Banerjee | C10G 65/04 208/89 |
| 2015/0315493 | A1 | 11/2015 | Morel | |
| 2020/0002626 | A1 | 1/2020 | Dupuy | |

FOREIGN PATENT DOCUMENTS

| | | | |
|---|---|---|---|
| EP | 2501785 | A2 | 9/2012 |
| WO | 2022/029233 | A1 | 2/2022 |

* cited by examiner

PROCESS FOR THE PRODUCTION OF WHITE OILS

FIELD OF THE INVENTION

The invention relates to a process for the production of white oils having a very low aromatic content.

BACKGROUND ART

White oils are known for the skilled person and correspond to highly refined mineral oils and thus are of high purity. White oils generally fall into two classes, technical grade and medicinal grade. Medicinal grade white oils are typically chemically inert and substantially without color, odor, or taste. The technical grade white oils are generally used in textile lubrication, sealants, adhesives or bases for insecticides. The more highly refined medicinal grade white oils are those suitable for use in drug compositions, cosmetics, foods, and for the lubrication of food handling machinery.

White oils have high stability properties, in particular high thermal stability, are chemically inert, without odor and without color. White oils are notably defined in the Code of Federal Regulation of the FDA for example in sections 21 C.F.R. § 172.878 regarding direct food additives, 21 C.F.R. § 178.3620 (a) regarding indirect food additives, 21 C.F.R. § 573.680 regarding animal food additives and H1 food processing lubricant standards, 21 C.F.R. § 178.3620 (b) regarding indirect food additives and 21 C.F.R. § 573.680 regarding animal food additives. White oils are also defined in the French and European Pharmacopoeia.

White oils are generally produced by refining an appropriate petroleum feedstock to remove oxygen, nitrogen, and sulfur compounds, reactive hydrocarbons such as aromatics, and any other impurity which would prevent use of the resulting white oil in the pharmaceutical or food industry.

EP 1 171 549 discloses a hydrofining process of a hydrocarbon feedstock having a substantial amount of sulphur at temperatures ranging from 200 to 400° C. in order to produce white oils.

The inventors surprisingly discovered that the processes of the prior art leads to by-products, notably cracking products, and thus to a loss of yield of the process.

There is thus a need for a process for producing white oils with higher yields, with a process easy to implement and with a reduced cost, without involving high amounts of sulphur.

SUMMARY OF THE INVENTION

The invention provides a process for producing a white oil having an initial boiling point of at least 250° C., the process comprising a step of catalytically hydrogenating a base oil feedstock at a temperature of from 120 to 210° C., at a pressure of from 30 to 160 bars and a liquid hourly space velocity of 0.2 to 5 $hr^{-1}$, the base oil feedstock comprising less than 5 ppm by weight of sulphur.

According to an embodiment, the base oil feedstock comprises less than 3 ppm by weight, preferably less than 1 ppm by weight of sulphur.

According to an embodiment, the base oil feedstock has an initial boiling point ranging from 250 to 350° C. and a final boiling point ranging from 350 to 600° C.

According to an embodiment, the base oil feedstock has a viscosity at 40° C. of at least 6 cSt, preferably at least 7 cSt, more preferably at least 7.5 cSt.

According to an embodiment, the base oil feedstock is selected from Groups II III, IV and mixture thereof, preferably from Groups II and III, more preferably from Group III, of the API classification.

According to an embodiment, the base oil feedstock is selected from oils issued from a hydrocracking process and from oils issued from a deep desulphurization process.

According to an embodiment, the hydrogenating step is performed at a temperature ranging from 150 to 200° C., preferably from 150 to 190° C.

According to an embodiment, the hydrogenating step is performed at a pressure ranging from 50 to 150 bars, preferably from 50 to 130 bars.

According to an embodiment, the hydrogenating step is performed at a liquid hourly space velocity ranging from 0.4 to 3 $hr^{-1}$, preferably from 0.5 to 1.5 $hr^{-1}$.

According to an embodiment, the catalyst is a nickel catalyst, preferably a supported nickel catalyst.

According to an embodiment, the catalyst is not in a sulfided form when the hydrogenation step is started.

According to an embodiment, the hydrogenating step is performed in a unit comprising at least 2 reactors, preferably in series.

According to an embodiment, the process further comprises a fractionating step, preferably performed after the hydrogenating step.

According to an embodiment, the white oil has an aromatic content below 1000 ppm by weight, preferably below 500 ppm by weight, more preferably below 300 ppm by weight, even more preferably below 200 ppm by weight.

White oils produced thanks to the process of the invention reply to the purity criterion of the European Pharmacopoeia (monography on liquid paraffins of pharmacopeia EuPh 6.0 January 2008), of the US Pharmacopeia (US Pharmacopoeia Light Mineral Oil, USP32-NF 27), and of the Japanese Pharmacopeia (Japanese Pharmacopoeia Light liquid Paraffin).

DESCRIPTION OF EMBODIMENTS OF THE INVENTION

Figure 1:
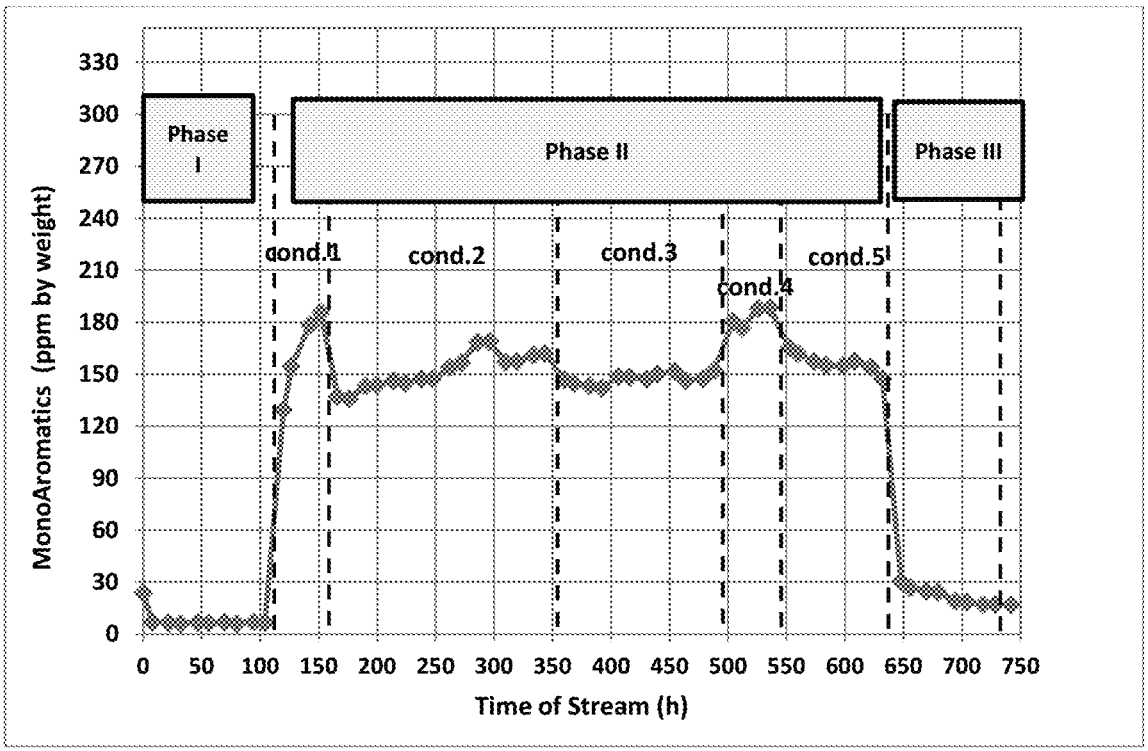
FIG. 1 represents the evolution of the amount of monoaromatic compounds during the different phases of the example 2.

The present invention relates to a process for producing a white oil having an initial boiling point of at least 250° C., the process comprising a step of catalytically hydrogenating a base oil feedstock at a temperature of from 120 to 210° C., at a pressure of from 30 to 160 bars and a liquid hourly space velocity of 0.2 to 5 $hr^{-1}$, the base oil feedstock comprising less than 5 ppm by weight of sulphur.

Within the meaning of the present invention, the IBP is different from the FBP of a product, this applies for example for the feedstock and for the white oil.

Feedstock (Also Named "Feed"):

The base oil feed typically comprises less than 5 ppm by weight of sulphur, preferably less than 3 ppm by weight, more preferably less than 1 ppm by weight. The sulphur content can be measured according to ASTM D2622 standard using X-ray Fluorescence.

The base oil feed typically has an initial boiling point (IBP) ranging from 250 to 350° C. and a final boiling point (FBP) ranging from 350 to 600° C. The IBP and FBP can be measured according to ASTM D86 standard and/or ASTM D1160 standard. ASTM D1160 standard is used to measure boiling points above 400° C. The boiling range, i.e. the difference between the IBP and the FBP, is preferably lower than 200° C., more preferably lower than 150° C., even more preferably lower than 100° C.

According to an embodiment, the base oil feed has a boiling range within the range of 250-400° C., preferably of 270-380° C., i.e. the initial and the final boiling point are preferably within the range of 250-400° C. or 270-380° C.

The base oil feed typically has a viscosity at 40° C. of at least 6.0 $mm^2/s$, preferably at least 7.0 $mm^2/s$, more preferably at least 7.5 $mm^2/s$. The viscosity can be measured according to ASTM D445 standard.

According to an embodiment of the invention, the feedstock has an aromatic content ranging from 5 ppm to 1% by weight, preferably from 50 ppm to 500 ppm by weight, based on the total weight of the feedstock. The aromatic content can be measured by UV spectrometry.

According to an embodiment of the invention, the base oil feedstock has a density at 15° C. ranging from 0.8100 to 0.8700 g/mL, preferably from 0.8200 to 0.8600 g/mL. The density at 15° C. can be measured according to ISO 12185 standard.

The process of the invention can typically comprise a step of providing a base oil feed as defined in the present invention for the hydrogenating step, for example a base oil comprising less than 5 ppm by weight of sulphur, having an initially boiling point (IBP) ranging from 250 to 350° C. and a final boiling point (FBP) ranging from 350 to 600° C. and having a viscosity at 40° C. of at least 6.0 $mm^2/s$.

According to an embodiment, the base oil feedstock is selected from oils issued from a hydrocracking process and from oils issued from a deep desulphurization process, preferably from a hydrocracking process.

According to this embodiment, the hydrocracking process can be performed on a hydrocarbon feedstock and the heaviest fraction issued from the hydrocracking process may be used as the base oil feed of the process of the present invention.

The base oil feedstock can be defined as specified in the American Petroleum Institute (API) Base Oil Interchangeability Guidelines. There are five base oil groups that are as given in the table that follows.

| | Saturates | Sulfur | Viscosity index (VI) |
|---|---|---|---|
| Group I mineral oils | <90% | >0.03% | 80 ≤ VI < 120 |
| Group II hydrocracked oils | ≥90% | ≤0.03% | 80 ≤ VI < 120 |
| Group III hydrocracked oils or hydroisomerized oils | ≥90% | ≤0.03% | ≥120 |
| Group IV | Polyalphaolefins (PAO) | | |
| Group V | Esters and other bases not included in Groups I to IV | | |

According to an embodiment of the invention, the base oil feedstock is selected from Groups II, III or IV or mixtures thereof, more preferably from Groups II or III, even more preferably from a base oil of Group III.

Hydrogenation Step.

The feedstock is hydrogenated. The feedstock can optionally be pre-fractionated.

Hydrogen that is used in the hydrogenation unit is typically a high purity hydrogen, e.g. with a purity of more than 99%, albeit other grades can be used.

Hydrogenation takes place in one or more reactors. The reactor can comprise one or more catalytic beds. Catalytic beds are usually fixed beds.

Hydrogenation takes place using a catalyst. Typical hydrogenation catalysts include but are not limited to: nickel, platinum, palladium, rhenium, rhodium, nickel tungstate, nickel molybdenum, molybdenum, cobalt molybdenate, nickel molybdenate on silica and/or alumina carriers or zeolites. A preferred catalyst is Ni-based and is supported on an alumina carrier, having preferably a specific surface area varying between 100 and 200 $m^2/g$ of catalyst. According to a particular embodiment, the catalyst consists in nickel as metallic compound.

The hydrogenation conditions are typically the following:

Pressure: 30 to 160 bars, preferably 40 to 150 bars, and most preferably 50 to 130 bars;

Temperature: 120 to 210° C., preferably 125 to 200° C. and most preferably 130 to 190° C.;

Liquid hourly space velocity (LHSV): 0.2 to 5 $hr^{-1}$, preferably 0.4 to 3, and most preferably 0.5 to 1.5;

Hydrogen treat rate: adapted to the above conditions, which can be up to 200 $Nm^3$/ton of feed.

The temperature in the reactors can be typically about 120-190° C. and the pressure can be typically from 50 to 100 bars while the liquid hourly space velocity can be typically about 1 $h^{-1}$ and the treat rate is adapted, depending on the feed quality and the first process parameters.

The hydrogenation process of the invention can be carried out in several stages. There can be two or three stages, preferably three stages, preferably in three separate reactors. The first stage will operate the sulphur trapping, hydrogenation of substantially all unsaturated compounds, and up to about 90% of hydrogenation of aromatics. The flow exiting from the first reactor contains substantially no sulphur. In the second stage the hydrogenation of the aromatics continues, and up to 99% of aromatics are hydrogenated. The third stage is a finishing stage, allowing an aromatic content as low as 1000 ppm by weight or even less such as below 500 ppm, more preferably less than 200 ppm, even for high boiling products.

The catalysts can be present in varying or substantially equal amounts in each reactor, e.g. for three reactors according to weight amounts of 0.05-0.5/0.10-0.70/0.25-0.85, preferably 0.07-0.25/0.15-0.35/0.4-0.78 and most preferably 0.10-0.20/0.20-0.32/0.48-0.70.

It is also possible to have one or two hydrogenation reactors instead of three.

It is also possible that the first reactor be made of twin reactors operated alternatively in a swing mode. This may be useful for catalyst charging and discharging: since the first reactor comprises the catalyst that is poisoned first (substantially all the sulphur is trapped in and/or on the catalyst) it should be changed often.

One reactor can be used, in which two, three or more catalytic beds are installed.

It may be necessary to insert quenches on the recycle to cool effluents between the reactors or catalytic beds to control reaction temperatures and consequently hydrothermal equilibrium of the hydrogenation reaction. In a preferred embodiment, there is no such intermediate cooling or quenching.

In case the process makes use of 2 or 3 reactors, the first reactor will act as a sulphur trap. This first reactor will thus trap substantially all the sulphur. The catalyst will thus be saturated quickly and may be renewed from time to time. When regeneration or rejuvenation is not possible for such saturated catalyst the first reactor is considered as a sacrificial reactor which size and catalyst content both depend on the catalyst renewal frequency.

In an embodiment the resulting product and/or separated gas is/are at least partly recycled to the inlet of the hydrogenation stages. This dilution helps, if this were to be needed, maintaining the exothermicity of the reaction within controlled limits, especially at the first stage. Recycling also allows heat-exchange before the reaction and also a better control of the temperature.

The stream exiting the hydrogenation unit contains the hydrogenated product and hydrogen. Flash separators are used to separate effluents into gas, mainly remaining hydrogen, and liquids, mainly hydrogenated hydrocarbons. The process can be carried out using three flash separators, one of high pressure, one of medium pressure, and one of low pressure, very close to atmospheric pressure.

The hydrogen gas that is collected on top of the flash separators can be recycled to the inlet of the hydrogenation unit or at different levels in the hydrogenation units between the reactors.

Because the final separated product is at about atmospheric pressure, it is possible to feed directly the optional fractionation stage, which is preferably carried out under vacuum pressure that is at about between 10 to 50 mbars, preferably about 30 mbars.

The optional fractionation stage can be operated such that various hydrocarbon fluids can be withdrawn simultaneously from the fractionation column, and the boiling range of which can be predetermined.

Therefore, fractionation can take place before hydrogenation, after hydrogenation, or both.

The hydrogenation reactors, the separators and the fractionation unit can thus be connected directly, without having to use intermediate tanks. By adapting the feed, especially the initial and final boiling points of the feed, it is possible to produce directly, without intermediate storage tanks, the final products with the desired initial and final boiling points. Moreover, this integration of hydrogenation and fractionation allows an optimized thermal integration with reduced number of equipment and energy savings.

White Oils

The invention thus discloses a white oil cut that can be obtained by the process of the invention. The white oil cut typically has an initial boiling point higher than 250° C. and an aromatic content of less than 1000 ppm by weight. The aromatic content can be measured by UV spectrometry.

According to a preferred embodiment, the aromatic content of the white oil is less than 200 ppm by weight, preferably less than 100 ppm by weight, more preferably less than 80 ppm by weight.

According to a preferred embodiment, the white oil obtained in the invention has boiling points within the range of from 300 to 420° C., preferably from 310 to 410° C.

According to an embodiment, the white oil obtained in the invention has one or several of the following features:

- a density at 15° C. ranging from 0.8100 to 0.8700 g/mL, preferably from 0.8200 to 0.8600 g/mL, and/or
- a Saybolt colour higher than or equal to +30, measured according to NF M 07003 standard, and/or
- a Cleveland Flash Point ranging from 150 to 250° C., preferably from 175 to 225° C., more preferably from 190 to 200° C., measured according to ASTM D92 standard, and/or
- a viscosity at 40° C. ranging from 6 to 25 $mm^2/s$, preferably from 7.5 to 21 $mm^2/s$, and/or
- an aniline point of at least 70° C., preferably at least 90° C., measured according to ISO 2977 standard, and/or
- a pour point ranging from −40° C. to +10° C., preferably from −30° C. to −5° C., measured according to ISO 3016 standard, and/or
- a refractive index at 20° C. according to ASTM D1218 ranging from 1.4500 to 1.4850, preferably from 1.4600 to 1.4800.

The following example illustrates the invention without limiting it.

EXAMPLES

The unit that was used in the examples is a unit comprising two reactors in series.

Example 1: Production of White Oil from a Base Oil A

Example 1a: Description of the Feed and Preparation of the Unit

A base oil A having the features detailed in table 1 below has been submitted to a catalytic hydrogenation.

TABLE 1 base oil A characterization analysis

| Characteristics and methods | values | units |
|---|---|---|
| density @ 15° C. | 0.8304 | g/mL |
| Distillation ASTM D86 T° C. @ IBP | 282.2 | ° C. |
| T° C. @ 5% vol | 299.8 | ° C. |
| T° C. @ 10% vol | 306.8 | ° C. |
| T° C. @ 20% vol | 316.2 | ° C. |
| T° C. @ 30% vol | 324.2 | ° C. |
| T° C. @ 40% vol | 331.8 | ° C. |
| T° C. @ 50% vol | 338.3 | ° C. |
| T° C. @ 60% vol | 344.7 | ° C. |
| T° C. @ 70% vol | 351.2 | ° C. |
| T° C. @ 80% vol | 358.5 | ° C. |
| T° C. @ 90% vol | 368.3 | ° C. |
| T° C. @ 95% vol | 376.4 | ° C. |
| T° C. @ FBP | 377.4 | ° C. |
| Flash point Pensky Martens ASTM D 93 | 147.6 | ° C. |
| Kinematic Viscosity ASTM D445 @ 40° C. | 7.684 | $mm^2/s$ |
| Aromatics by UV method | 200 | ppm |
| Sulphur by ASTM D4294 | 0.1 | ppm |

The catalyst used was a Nickel supported on alumina catalyst. The catalyst has been reduced in situ with hydrogen before introducing the feed, for example with 80 Nl/h of hydrogen for 1 hour.

Before introducing the base oil feed A, the catalytic system has been first subjected to a stabilization phase using a standard gas oil feed, at 150° C., LHSV of 1.5 $h^{-1}$ and a hydrogen pressure of 100 bars. After 60 hours on stream, a stable monoaromatic content of 8 ppm by weight was reached.

Example 1b: Process of the Invention

Then, after the stabilization phase, a catalytic dehydrogenation has been performed on the base oil feed A detailed in table 1 with the following conditions: a temperature of 130° C., a LHSV of 1 $h^{-1}$ and a pressure of 100 bars.

The unit of the catalytic hydrogenation stabilized to a monoaromatic content outlet of 80 ppm by weight.

The sample was then distilled in two fractions. The heaviest fraction (315° C.+) has a monoaromatic content of 95 ppm by weight.

This heaviest fraction satisfies the specifications of a white oil, in particular the purity criterion of the according to European Pharmacopeia of the monography of the liquid paraffins (EuPh 6.0 January 2008), of the US Pharmacopoeia Light Mineral Oil, USP32-NF 27, and of the Japanese Pharmacopoeia Light liquid Paraffin.

Example 1c: Control of the Deactivation of the Catalyst

Finally, after 100 hours of test (stabilization of example 1a and example 1b), the unit was set to the same conditions as of the stabilization phase (with the standard gas oil feed) and maintained for about 100 more hours, a stable monoaromatic content of 7 ppm by weight was reached, which indicates that no catalyst deactivation occurred.

During all the experiment, the mass balance was >99%, calculated according to the following formula:

$$\text{mass balance} = 1 - \left(\frac{\text{IN} - \text{OUT}}{\text{IN}}\right)$$

wherein IN represents the total mass of liquid and gas at the inlet of the reactor and OUT represents the total mass of liquid and gas at the outlet of the reactor.

Example 2: Production of White Oil from a Base Oil B

Example 2a: Description of the Feed and Preparation of the Unit

A base oil B having the features detailed in table 2 below has been submitted to a catalytic hydrogenation.

TABLE 2 base oil B characterization analysis

| Characteristics and methods | values | units |
|---|---|---|
| Density @ 15° C. | 0.8311 | g/mL |
| Distillation ASTM D86 T° C. @ IBP | 339.9 | ° C. |
| T° C. @ 5% vol | 352.1 | ° C. |
| T° C. @ 10% vol | 354.3 | ° C. |
| T° C. @ 20% vol | 355.2 | ° C. |
| T° C. @ 30% vol | 356.4 | ° C. |
| T° C. @ 40% vol | 357.3 | ° C. |
| T° C. @ 50% vol | 360.3 | ° C. |
| T° C. @ 60% vol | 361.7 | ° C. |
| T° C. @ 70% vol | 364.9 | ° C. |
| T° C. @ 80% vol | 368.3 | ° C. |
| T° C. @ 90% vol | 373.9 | ° C. |
| T° C. @ 95% vol | 379.1 | ° C. |
| T° C. @ FBP | 379.1 | ° C. |
| % Recovered @ 350° C. (*) | 2.8 | % vol |
| % Recovered @ 370° C. (*) | 83.1 | % vol |
| Recovered % vol | 97.5 | % vol |
| Residue % vol | 2.5 | % vol |
| Loss % vol | 0 | % vol |
| (*) % Loss included Yes/No | y | — |
| Flash point Pensky Martens ASTM D 93 | 206 | ° C. |
| Pour point ASTM D5950 (rep. D97) | <−30 | ° C. |
| Kinematic Viscosity ASTM D445 @ 20° C. | 24.27 | $mm^2/s$ |
| Kinematic Viscosity ASTM D445 @ 40° C. | 11.46 | $mm^2/s$ |
| Total Nitrogen by Chemiluminescene | 10.6 | ppm |
| Sulphur by UVF ppm | 2.8 | ppm |
| Monoaromatics by UV method | 301.8 | mg/kg |

The catalyst used was a Nickel supported on alumina catalyst. The catalyst has been reduced in situ with hydrogen before introducing the feed, for example with 80 Nl/h of hydrogen for 1 hour.

Before introducing the base oil feed A, the catalytic system has been first subjected to a stabilization phase using a standard gas oil feed, at 150° C., LHSV of 1.5 $h^{-1}$ and a hydrogen pressure of 100 bars. After 60 hours on stream, a stable monoaromatic content of 8 ppm by weight was reached.

Example 2b: Process of the Invention

After stabilization phase, temperature was decreased to 130° C. (ramp, 20° C./h) and pressure reduced to 50 bar. Base oil feed B was introduced. The test continued according to the conditions detailed in table 3 below.

Example 2c: Control of the Deactivation of the Catalyst

Finally, after 530 hours of test, the unit was set to the same conditions as of the stabilization phase and maintained for about 100 more hours, a stable monoaromatic content of 8 ppm by weight was reached (see FIG. 1), which indicates no catalyst deactivation occurred.

FIG. 1 presents the monoaromatic content in ppm by weight of the outlet stream during the phase I which is the stabilization phase, the phase II comprising the five conditions detailed in table 3, and the phase III corresponding to example 2c performed in order to evaluate the deactivation of the catalyst.

At the end of each condition of example 2b (cond. 1 to 5), the sample that has been taken up satisfies the specifications for a white oil (purity criterion of pharmacopeia).

TABLE 3

Description of the phase of the example 2

| | Stabilization phase | Example 2b Test (According to the invention) Conditions | | | | | Example |
|---|---|---|---|---|---|---|---|
| | (example 2a) Fresh feed | Cond. 1 | Cond. 2 Fresh feed | Cond. 3 | Cond. 4 Diluted feed** | Cond. 5 | 2c Fresh feed |
| Pressure (barg) | 100 | 50 | 100 | 100 | 50 | 100 | 100 |
| LHSV ($h^{-1}$) | 1.5 | 1 | 1 | 1 | 1 | 1 | 1.5 |
| Feed rate (mL/h) | 168 | 112 | 112 | 112 | 112 | 112 | 168 |
| $H_2$/feed (NL/L) | 100 | 54 | 54 | 54 | 54 | 54 | 100 |
| Hydrogen flow (NL/h) | 16.8 | 6 | 6 | 6 | 6 | 6 | 16.8 |
| WABT* (° C.) (Reactor 1) | 150 | 130 | 130 | 150 | 130 | 130 | 150 |
| WABT* (° C.) (Reactor 2) | 150 | 130 | 130 | 150 | 130 | 130 | 150 |
| Duration of condition (h) | 120 | 50 | 190 | 150 | 50 | 90 | 100 |

*WABT: Weight Average Bed Temperature

**43% wt of fresh feed and 57% wt of recycled product from the outlet (exit) of the reactor During all the experiment, the mass balance was >99%, calculated according to the following formula:

$$\text{mass balance} = 1 - \left(\frac{\text{IN} - \text{OUT}}{\text{IN}}\right)$$

wherein IN represents the total mass of liquid and gas at the inlet of the reactor and OUT represents the total mass of liquid and gas at the outlet of the reactor.

Example 3: Evaluation of the Effect of the Temperature

Example 3a: Description of the Feed and Preparation of the Unit

A base oil C having the features detailed in table 4 below has been submitted to a catalytic hydrogenation.

TABLE 4 base oil C characterization analysis

| Characteristics and methods | values | units |
|---|---|---|
| Density @ 15° C. | 0.8298 | g/mL |
| Distillation ASTM D86 T° C. @ IBP | 322.7 | ° C. |
| T° C. @ 5% vol | 345.2 | ° C. |
| T° C. @ 10% vol | 350.1 | ° C. |
| T° C. @ 20% vol | 352.5 | ° C. |
| T° C. @ 30% vol | 355.0 | ° C. |
| T° C. @ 40% vol | 357.7 | ° C. |
| T° C. @ 50% vol | 360.3 | ° C. |
| T° C. @ 60% vol | 363.3 | ° C. |
| T° C. @ 70% vol | 366.5 | ° C. |
| T° C. @ 80% vol | 370.8 | ° C. |
| T° C. @ 90% vol | 376.8 | ° C. |
| T° C. @ 95% vol | 381.8 | ° C. |
| T° C. @ FBP | 381.9 | ° C. |
| Flash point Pensky Martens ASTM D 93 | 206 | ° C. |
| Pour point ASTM D5950 (rep. D97) | −36 | ° C. |
| Aniline Point ASTM D611 | 107.2 | ° C. |
| Kinematic Viscosity ASTM D445 @ 40° C. | 11.37 | $mm^2/s$ |
| Sulphur by UVF ppm | 0.1 | ppm |
| Monoaromatics by UV method | 522 | mg/kg |

The catalyst used was a Nickel supported on alumina catalyst. The catalyst has been reduced in situ with hydrogen before introducing the feed, for example with 80 Nl/h of hydrogen for 1 hour.

Before introducing the base oil feed A, the catalytic system has been first subjected to a stabilization phase using a standard gas oil feed, at 150° C., LHSV of 1.5 $h^{-1}$ and a hydrogen pressure of 100 bars. After 60 hours on stream, a stable monoaromatic content of 8 ppm by weight was reached.

Example 3b: Process of the Invention

Then, after the stabilization phase, a catalytic dehydrogenation has been performed on the base oil feed A detailed in table 4 with the following conditions: a temperature of 130° C., a LHSV of 1 $h^{-1}$ and a pressure of 100 bars.

The test continued by performing temperature steps of 20° C., up to 210° C.

Figure 2:
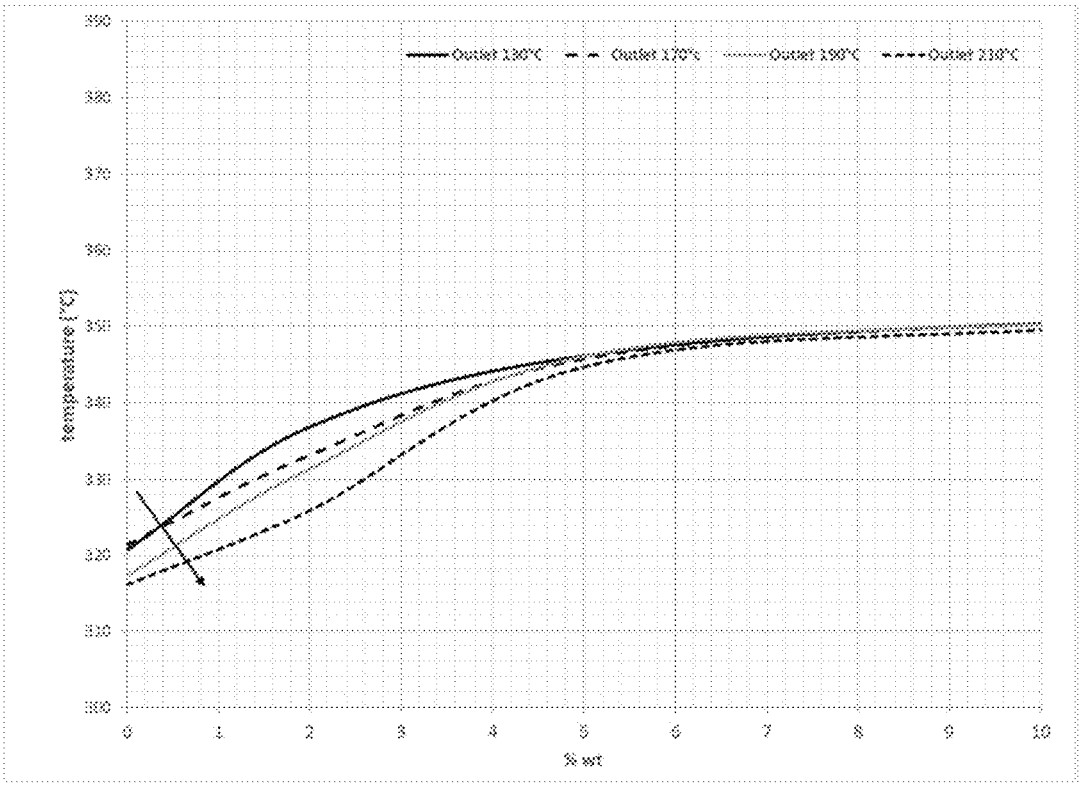
FIG. 2 represents the amount of compounds in function of their boiling temperature, for different hydrogenation temperatures.

FIG. 2 presents the results obtained during the test, i.e. the proportions of compounds in function of the boiling point of the compounds.

It can be clearly observed in FIG. 2 that with increasing temperature some cracking reactions occur, producing some lighter components.

Example 4: Production of White Oil from a Base Oil D

Example 4a: Description of the Feed and Preparation of the Unit

A base oil D having the features detailed in table 5 below has been submitted to a catalytic hydrogenation.

TABLE 5 base oil D characterization analysis

| Characteristics and methods | Values | Units |
|---|---|---|
| Density @ 15° C. | 0.8521 | g/mL |
| Distillation ASTM D86 T° C. @ IBP | 323.6 | ° C. |
| T° C. @ 5% vol | 341.2 | ° C. |
| T° C. @ 10% vol | 346.7 | ° C. |
| T° C. @ 20% vol | 351.3 | ° C. |
| T° C. @ 30% vol | 356.0 | ° C. |
| T° C. @ 40% vol | 360.6 | ° C. |
| T° C. @ 50% vol | 366.1 | ° C. |
| T° C. @ 60% vol | 371.2 | ° C. |
| T° C. @ 70% vol | 377.7 | ° C. |
| T° C. @ 80% vol | 385.7 | ° C. |
| T° C. @ 90% vol | 398.1 | ° C. |
| T° C. @ 95% vol | 410.6 | ° C. |
| T° C. @ FBP | 414.0 | ° C. |
| Flash point Pensky Martens ASTM D 93 | 185.5 | ° C. |
| Pour point ASTM D5950 (rep. D97) | −22 | ° C. |
| Aniline Point ASTM D611 | 103.8 | ° C. |
| Kinematic Viscosity ASTM D445 @ 20° C. | 35.79 | $mm^2/s$ |
| Kinematic Viscosity ASTM D445 @ 40° C. | 15.58 | $mm^2/s$ |
| Total Nitrogen by Chemiluminescene | 1.6 | ppm |
| Aromatic content by UV method | <100 | ppm |
| Sulphur by UVF ppm | 2.16 | ppm |

The catalyst used was a Nickel supported on alumina catalyst. The catalyst has been reduced in situ with hydrogen before introducing the feed, for example with 80 Nl/h of hydrogen for 1 hour.

Before introducing the base oil feed D, the catalytic system has been first subjected to a stabilization phase using a gas oil feed, at 150° C., LHSV of 1.5 $h^{-1}$ and a hydrogen pressure of 100 bars. After 60 hours on stream, a stable monoaromatic content of 8 ppm by weight was reached.

Example 4b: Process of the Invention

After stabilization, the unit was set to the following conditions (Cond. 1): T=150° C., LHSV=1 $h^{-1}$, P=50 bars. Base oil feed D was introduced. The test continued by increasing pressure to 100 bars for a second conditions (Cond. 2). Table 6 presents the results obtained during the test for the 2 testing conditions.

TABLE 6 product characterization analysis (condition 1 and 2).

| Analyze | Method | Unit | Cond. 1 | Cond.2 |
|---|---|---|---|---|
| Density at 15° C. | EN ISO 12185 | $kg/m^3$ | 851.9 | 852.0 |
| Appearance | VISUAL | | Clear & Bright | Clear & Bright |
| Saybolt colour | NF M 07003 | | >+30 | >+30 |
| Cleveland Flash Point | ASTM D92 | ° C. | 192 | 194 |
| Viscosity at 40° C. | EN ISO 3104 | $mm^2/s$ | 15.625 | 15.659 |
| Viscosity at 100° C. | EN ISO 3104 | $mm^2/s$ | 3.482 | 3.488 |
| Aniline Point | ISO 2977 | ° C. | 104.1 | 104.4 |
| Pour point | ISO 3016 | ° C. | −24 | −27 |

TABLE 6-continued

| product characterization analysis (condition 1 and 2). | | | | |
|---|---|---|---|---|
| Aromatic content | UV method | ppm | 46 | 32 |
| Sulfur content | NF M 07059 | ppm | <1 | <1 |
| Refractive index | | | 1.4674 | 1.4674 |
| Distillation D86 | | Unit | | |
| Initial Point | EN ISO 3405 | ° C. | 321.6 | 317.8 |
| 2% Point | EN ISO 3405 | ° C. | 335.0 | 336.7 |
| 5% Point | EN ISO 3405 | ° C. | 341.8 | 344.5 |
| 10% Point | EN ISO 3405 | ° C. | 346.4 | 348.3 |
| 20% Point | EN ISO 3405 | ° C. | 351.3 | 352.7 |
| 30% Point | EN ISO 3405 | ° C. | 356.1 | 357.1 |
| 40% Point | EN ISO 3405 | ° C. | 361.2 | 361.7 |
| 50% Point | EN ISO 3405 | ° C. | 366.0 | 366.3 |
| 60% Point | EN ISO 3405 | ° C. | 370.8 | 371.1 |
| 65% Point | EN ISO 3405 | ° C. | 372.9 | 373.5 |
| 70% Point | EN ISO 3405 | ° C. | 376.2 | 376.7 |
| 80% Point | EN ISO 3405 | ° C. | 383.5 | 384.1 |
| 90% Point | EN ISO 3405 | ° C. | 394.0 | 395.5 |
| Dry Point | EN ISO 3405 | ° C. | 401.0 | 402.6 |
| European Pharmacopeia evaluation (purity) | | | Conform | Conform |

Example 5: Production of White Oil from a Base Oil E

Example 5a: Description of the Feed and Preparation of the Unit

A base oil E having the features detailed in table 7 below has been submitted to a catalytic hydrogenation.

TABLE 7

| base oil E characterization analysis | | |
|---|---|---|
| Characteristics and methods | Values | Units |
| Density @ 15° C. | 0.8366 | g/mL |
| *Distillation ASTM D2887 T° C. @ IBP | 317.0 | ° C. |
| T° C. @ 5% wt | 361.0 | ° C. |
| T° C. @ 10% wt | 367.0 | ° C. |
| T° C. @ 20% wt | 393.0 | ° C. |
| T° C. @ 30% wt | 405.0 | ° C. |
| T° C. @ 40% wt | 416.0 | ° C. |
| T° C. @ 50% wt | 426.0 | ° C. |
| T° C. @ 60% wt | 437.0 | ° C. |
| T° C. @ 70% wt | 450.0 | ° C. |

TABLE 7-continued

| base oil E characterization analysis | | |
|---|---|---|
| Characteristics and methods | Values | Units |
| T° C. @ 80% wt | 466.0 | ° C. |
| T° C. @ 90% wt | 489.0 | ° C. |
| T° C. @ 95% wt | 510 | ° C. |
| T° C. @ FBP | 561 | ° C. |
| Flash point Pensky Martens ASTM D 93 | 204.0 | ° C. |
| Pour point ASTM D5950 (rep. D97) | 36 | ° C. |
| Aniline Point ASTM D611 | 103.8 | ° C. |
| Kinematic Viscosity ASTM D445 @ 20° C. | 4.181 | $mm^2/s$ |
| Kinematic Viscosity ASTM D445 @ 40° C. | 18.07 | $mm^2/s$ |
| Total Nitrogen by Chemiluminescene | 1.3 | ppm |
| Total Aromatic content by HLPC IP391 | 5.1 | % wt |
| Sulphur by UVF ppm | 4.8 | ppm |

*ASTM D86 distillation was not carried out due to the high distillation points

The catalyst used was a Nickel supported on alumina catalyst. The catalyst has been reduced in situ with hydrogen before introducing the feed, for example with 80 Nl/h of hydrogen for 1 hour.

Before introducing the base oil feed E, the catalytic system has been first subjected to a stabilization phase using a gas oil feed, at 150° C., LHSV of 1.5 $h^{-1}$ and a hydrogen pressure of 100 bars. After 60 hours on stream, a stable monoaromatic content of 8 ppm by weight was reached.

Example 5b: Process of the Invention

After stabilization, the unit was set to the following conditions (Cond. 1): T=150° C., LHSV=1 $h^{-1}$, P=130 bars. Base oil feed E was introduced. The test continued by increasing the temperature, pressure, and dilution ratio (hydrogenated Base oil feed E/fresh Base oil feed E. Table 8 presents the detailed operating conditions.

TABLE 8

| Description of the phases of the example 5 | | | | |
|---|---|---|---|---|
| | Cond. 1 | Cond. 2 | Cond. 3 | Cond. 4 |
| | Fresh feed | | Diluted feed | |
| Pressure (barg) | 130 | 130 | 150 | 150 |
| LHSV ($h^{-1}$) | 1 | 1 | 0.5 | 0.2 |
| Feed rate (mL/h) | 112 | 112 | 56 | 22.4 |
| $H_2$/feed (NL/L) | 150 | 150 | 130 | 130 |
| Hydrogen flow (NL/h) | 16.8 | 16.8 | 7.3 | 2.9 |
| WABT* (° C.) (Reactor 1) | 150 | 190 | 190 | 210 |
| Dilution ratio (hydrogenated/fresh feed) | — | — | 1.5 | 2.3 |

*WABT: Weight Average Bed Temperature

Table 9 presents the results obtained during the test for each of the testing conditions.

TABLE 9

| product characterization analysis (condition 1, 2, 3 and 4). | | | | | | |
|---|---|---|---|---|---|---|
| Analyze | Method | Unit | Cond. 1 | Cond. 2 | Cond. 3 | Cond. 4 |
| Density at 15° C. | EN ISO 12185 | $kg/m^3$ | 834.8 | 834.8 | 834.5 | 835.2 |
| Aromatic content | UV method | ppm | 1106 | 592 | 276 | 49 |
| Sulfur content | NF M 07059 | ppm | <0.6 | <0.6 | <0.6 | <0.6 |

The invention claimed is:

1. A process for producing a white oil having an initial boiling point of at least 250° C., the process comprising a step of catalytically hydrogenating a base oil feedstock at a temperature of from 120 to 210° C., at a pressure of from 30 to 160 bars and a liquid hourly space velocity of 0.2 to 5 $hr^{-1}$, the base oil feedstock comprising less than 5 ppm by weight of sulphur, wherein the catalyst is not in a sulfided form when the hydrogenation step is started.

2. The process according to claim 1, wherein the base oil feedstock comprises less than 3 ppm by weight.

3. The process according to claim 1, wherein the base oil feedstock has an initial boiling point ranging from 250 to 350° C. and a final boiling point ranging from 350 to 600° C.

4. The process according to claim 1, wherein the base oil feedstock has a viscosity at 40° C. of at least 6 cSt.

5. The process according to claim 1, wherein the base oil feedstock is selected from Groups II, III, IV and mixture thereof of the API classification.

6. The process according to claim 1, wherein the base oil feedstock is selected from oils issued from a hydrocracking process and from oils issued from a deep desulphurization process.

7. The process according to claim 1, wherein hydrogenating step is performed at a temperature ranging from 150 to 200° C.

8. The process according to claim 1, wherein the hydrogenating step is performed at a pressure ranging from 50 to 150 bars.

9. The process according to claim 1, wherein the hydrogenating step is performed at a liquid hourly space velocity ranging from 0.4 to 3 $hr^{-1}$.

10. The process according to claim 1, wherein the catalyst is a nickel catalyst.

11. The process according to claim 1, wherein the hydrogenating step is performed in a unit comprising at least 2 reactors.

12. The process according to claim 1, further comprising a fractionating step.

13. The process according to claim 1, wherein the white oil has an aromatic content below 1000 ppm by weight.

14. A process for producing a white oil having an initial boiling point of at least 250° C., the process comprising a step of catalytically hydrogenating a base oil feedstock at a temperature of from 150 to 190° C., at a pressure of from 50 to 130 bars and a liquid hourly space velocity of 0.5 to 1.5 $hr^{-1}$, the base oil feedstock comprising less than 3 ppm by weight of sulphur, wherein the base oil feedstock has an initial boiling point ranging from 250 to 350° C. and a final boiling point ranging from 350 to 600° C., wherein the catalyst is not in a sulfided form when the hydrogenation step is started.

15. The process of claim 14, further comprising a fractionating step after the hydrogenating step.

16. The process of claim 11, wherein the hydrogenating step is performed in a unit comprising at least 2 reactors in series.

17. The process of claim 1, wherein the catalyst is a supported nickel catalyst.

18. The process of claim 1, wherein the base oil feedstock has a viscosity at 40° C. of at least 7 cSt.

* * * * *